US011219257B2

(12) United States Patent
Beneyto-Ferre et al.

(10) Patent No.: US 11,219,257 B2
(45) Date of Patent: Jan. 11, 2022

(54) SPORTS GARMENT

(71) Applicant: PUMA SE, Herzogenaurach (DE)

(72) Inventors: Jordi Beneyto-Ferre, Nuremberg (DE); Hugh Anthony Clarke, Aurachtal (DE); Baljinder Kaur Miles, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 71 days.

(21) Appl. No.: 15/735,101

(22) PCT Filed: Mar. 14, 2016

(86) PCT No.: PCT/EP2016/000458

§ 371 (c)(1),
(2) Date: Dec. 8, 2017

(87) PCT Pub. No.: WO2017/157403

PCT Pub. Date: Sep. 21, 2017

(65) Prior Publication Data

US 2018/0192719 A1 Jul. 12, 2018

(51) Int. Cl.

| | |
|---|---|
| ***A41D 27/28*** | (2006.01) |
| ***A41D 27/10*** | (2006.01) |
| ***A41D 13/005*** | (2006.01) |

(52) U.S. Cl.

CPC ..... *A41D 27/28* (2013.01); *A41D 13/0056* (2013.01); *A41D 27/10* (2013.01); *A41D 2500/10* (2013.01); *A41D 2500/50* (2013.01)

(58) Field of Classification Search

CPC ..... A41D 27/28; A41D 13/0056; A41D 13/0053; A41D 13/0158

See application file for complete search history.

(56) References Cited

U.S. PATENT DOCUMENTS

| | | | | |
|---|---|---|---|---|
| 2,897,506 A * | 8/1959 | Carter | ..... | A41D 27/28 2/87 |
| 4,195,364 A | 4/1980 | Bengtsson | | |
| 5,515,543 A * | 5/1996 | Gioello | ..... | A41D 27/28 2/69 |
| 7,721,349 B1 * | 5/2010 | Strauss | ..... | A41D 13/0053 2/102 |

(Continued)

FOREIGN PATENT DOCUMENTS

| | | |
|---|---|---|
| CA | 2539780 A1 | 4/2005 |
| CA | 2758457 C | 10/2010 |

(Continued)

*Primary Examiner* — Megan E Lynch

(74) *Attorney, Agent, or Firm* — Lucas & Mercanti, LLP

(57) ABSTRACT

A sports garment having a section covering the upper part of the body of a wearer during intended use of the garment, wherein a climate zone is arranged in the region covering each axillary area of the wearer during intended use. To improve the cooling of the axillary area efficiently, the climate zone has a plurality of fins which are arranged parallel to another and which are contacting the skin of the wearer during intended use of the garment, wherein the fins are extending along a defined height over a base material of the garment, wherein the fins are arranged in such a manner that the envelope of all fins has a kite-shape or rhomb-shape seen in the direction perpendicular onto the base material of the garment.

14 Claims, 3 Drawing Sheets

(56) References Cited

U.S. PATENT DOCUMENTS 8,336,117 B2 * 12/2012 Carter ..... A41D 15/005 2/87
9,635,889 B1 * 5/2017 Copeland ..... A41D 13/0056
9,772,166 B2 * 9/2017 Shelton ..... A41D 27/28
2003/0061650 A1 * 4/2003 Emanuel ..... A41B 9/06 2/115
2004/0111782 A1 * 6/2004 Lenormand ..... A41D 13/05 2/69
2005/0015865 A1 * 1/2005 Chaix ..... A41D 13/0015 2/456
2005/0081277 A1 * 4/2005 Matechen ..... A41D 13/0156 2/102
2005/0086721 A1 * 4/2005 Lambertz ..... A41D 13/002 2/69
2005/0204449 A1 * 9/2005 Baron ..... A41D 1/04 2/69
2007/0022510 A1 * 2/2007 Chapuis ..... A41D 13/0015 2/69
2007/0094762 A1 * 5/2007 Carter ..... A41D 15/005 2/69
2009/0297756 A1 * 12/2009 Dehn ..... A41D 27/28 428/68
2010/0011489 A1 * 1/2010 Goldmann ..... A41D 13/002 2/455
2010/0011491 A1 * 1/2010 Goldmann ..... A41D 13/002 2/458
2011/0083246 A1 * 4/2011 Vitarana ..... A41D 13/0015 2/69
2011/0296580 A1 * 12/2011 Demarest ..... A41D 27/28 2/69
2012/0047619 A1 * 3/2012 Lambertz ..... A41D 27/28 2/69
2012/0174281 A1 * 7/2012 Mayer ..... B32B 5/026 2/69
2013/0298589 A1 * 11/2013 Holdsworth-Layton ..... A41D 13/0056 62/259.3
2014/0000004 A1 * 1/2014 Baron ..... A41B 1/00 2/69
2014/0208479 A1 * 7/2014 Lambertz ..... A41D 13/0015 2/69
2014/0310847 A1 * 10/2014 Ulriksen ..... A41D 27/28 2/69
2017/0023267 A1 * 1/2017 Strauss ..... F24F 5/0035
2017/0028669 A1 * 2/2017 Regester ..... B32B 3/266
2017/0099898 A1 * 4/2017 Pezzimenti ..... A41D 27/28

FOREIGN PATENT DOCUMENTS

CN 201332700 Y 10/2009
CN 103619202 A 8/2012
DE 202006001380 U1 6/2006
DE 202008001340 U1 3/2008
GB 2516118 A 1/2015
JP 2006249595 A 9/2006
KR 200415997 Y1 5/2006
WO 2004064554 A1 8/2004

* cited by examiner

SPORTS GARMENT

The present application is a 371 of International application PCT/EP2016/000458, filed Mar. 14, 2016, the priority of this application is hereby claimed and this application is incorporated herein by reference.

BACKGROUND OF THE INVENTION

The invention relates to a sports garment having a section covering the upper part of the body of a wearer during intended use of the garment, wherein a climate zone is arranged in the region covering each axillary area of the wearer during intended use.

A sports garment of the generic kind is known from DE 20 2006 001 380 U1. Here a garment piece covering the upper part of the body of the wearer is supplied with climate zones in different sections. Climate zones are also provided in the axillary area. No specific design is suggested for the shape of the climate zone in the axillary area.

It was found that the tempering effect specifically in the axillary area is not satisfactory in all cases.

SUMMARY OF THE INVENTION

Thus, it is an object of the present invention to propose a sports garment of the kind mentioned above which allows an improved cooling effect in the axillary area, i.e. in the armpit region so that an efficient tempering effect is obtained. Evaporation of sweat should be facilitated so that the tempering of the body is improved.

The solution of this object according to the invention is characterized in that the climate zone in the axillary area comprises a plurality of fins which are arranged parallel to another and which are contacting the skin of the wearer during intended use of the garment, wherein the fins are extending along a defined height over a base material of the garment, wherein the fins are arranged in such a manner that the envelope of all fins has a kite-shape or rhomb-shape (diamond-shape) seen in the direction perpendicular onto the base material of the garment.

The envelope of the fins has to be understood as that shape which is obtained when all end points of the single fins are connected by an imaginary line; the shape of this imaginary line then forms a kite or a rhomb (diamond).

Preferably the kite-shaped or rhomb-shaped envelope has a height in vertical direction and a width in horizontal direction, wherein the height is between 120% and 160% of the width, specifically between 130% and 150%.

The whole section covering the upper part of the body of a wearer including the climate zones can be made by a knitting process.

Single fins can be arranged in the climate zone, wherein the single fin is distanced from the next fin by a distance which is at least 7 mm.

Also, at least one group of two fins can be arranged in the climate zone, wherein the group of two fins is distanced from the next fin by a distance which is at least 7 mm. Thereby, the length in horizontal direction of the fins of the group of two fins is preferably between 50 mm and 90 mm.

A further alternative provides that at least one group of three fins is arranged in the climate zone, wherein the group of three fins is distanced from the next fin by a distance which is at least 7 mm. Thereby, the length in horizontal direction of the fins of the group of three fins is preferably between 80 mm and 120 mm.

A specific preferred embodiment of the invention suggests that single fins are arranged in the (vertical) upper region and/or (vertical) bottom region of the envelope, wherein groups of two fins are following the single fins when moving forward to a (vertical) center region of the envelope and wherein at least one group of three fins is arranged in the center region of the envelope.

In the case of groups of two or three fins the fins of a group can be arranged adjacently with a distance of a maximum of 2 mm, preferably of a maximum of 1 mm.

The fins are preferably running continuously at the side of the base material which is facing the skin of the user.

On the other hand it can be provided that connection webs are arranged at the side of the base material which is facing away from the skin of the user, wherein the connection webs are bridging the bottom side of the fins. By doing so the fins can be formed by a folded section of fabric which is held in position by means of the web.

The height of the envelope is preferably between 140 mm and 200 mm. The width of the envelope is preferably between 120 mm and 150 mm.

The fins are preferably made of Polyester and Polyamide yarns.

Preferably the garment is produced in such a manner that it is in a tight or close fit at the body of the wearer. Also a seamless design of the garment (excluding the sleeves) is preferred.

The invention thus provides moisture storage fins or protrusions which are constructed using preferably electronic circular seamless machinery for knitting (which are known as such); the fins are positioned on the complete axillary section of the garment preferably in a diamond shape fashion wherein the height of this zone is preferably 1.4 times larger than its width.

The climate zone is preferably constructed by creating an extra knitting structure and holding the front yarns to create the fins in the fabric which are basically folds in the same.

Preferably the main fabrication contains at least polyester fibre on the back and polyamide fibre on the face; the base layer can also contain "Elastane" yarn.

Preferably, the complete axillary area is constructed by knitting a mesh structure with a high air permeability. The fins or protrusions are preferably surrounded in their totally by mesh material with a high permeability.

The fins (protrusions) are preferably distributed in incremental groups, with increasing number of fins bundled together towards the center of the diamond shaped area, i.e. of the envelope of the fins, with a maximum of three fins bundled together and a minimum of one fin.

In the bundles where three fins are collected and in the longitudinal direction of the main axis of the fins, at the edge of said bundle, preferably two fins are bundled together and in the next stitching node three fins are gathered as to diminish a puckering effect.

In the case of three adjacent fins (group with three fins) a longitudinal length of the same of at least 90 mm is preferred. In the case of two adjacent fins (group with two fins) a length of the fin between 50 mm and 90 mm is preferred.

The fins are created in order to store moisture in these areas, directly located in the axillary area of the garment. Warm areas of the body which produce maximum sweat are thereby identified through thermal camera imaging. The combination of engineered axillary structures as described and mesh area zones on the product aids to improve heat dissipation.

By the proposed solution the moisture exchange can be improved and the wearing comfort of the garment during sport is thus enhanced.

BRIEF DESCRIPTION OF THE DRAWING

In the drawings an embodiment of the invention is shown.

DETAILED DESCRIPTION OF THE INVENTION

Figure 1:
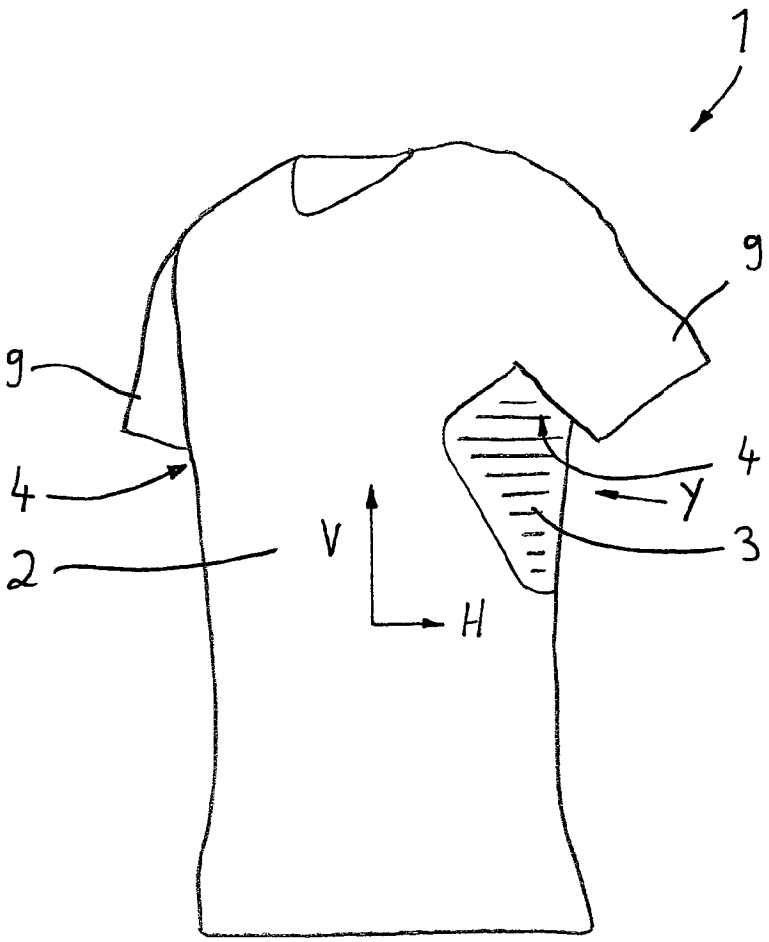
FIG. 1 shows a perspective view of a sports garment for covering the upper part of the body of a wearer.

In the figures a sports garment 1 and details of the same are shown. The sports garment 1 is presently at shirt which has a section 2 which is covering the upper part of the body of the wearer during intended use of the garment 1. Two sleeves 9 are provided; below the sleeves 9 the axillary area 4 is located. In each axillary area a single climate zone 3 is provided.

A vertical direction V as well as a horizontal direction H is denoted in FIG. 1 which has to be understood as the vertical and horizontal direction, when the garment 1 is worn by a wearer which stands upright on the ground.

Figure 2:
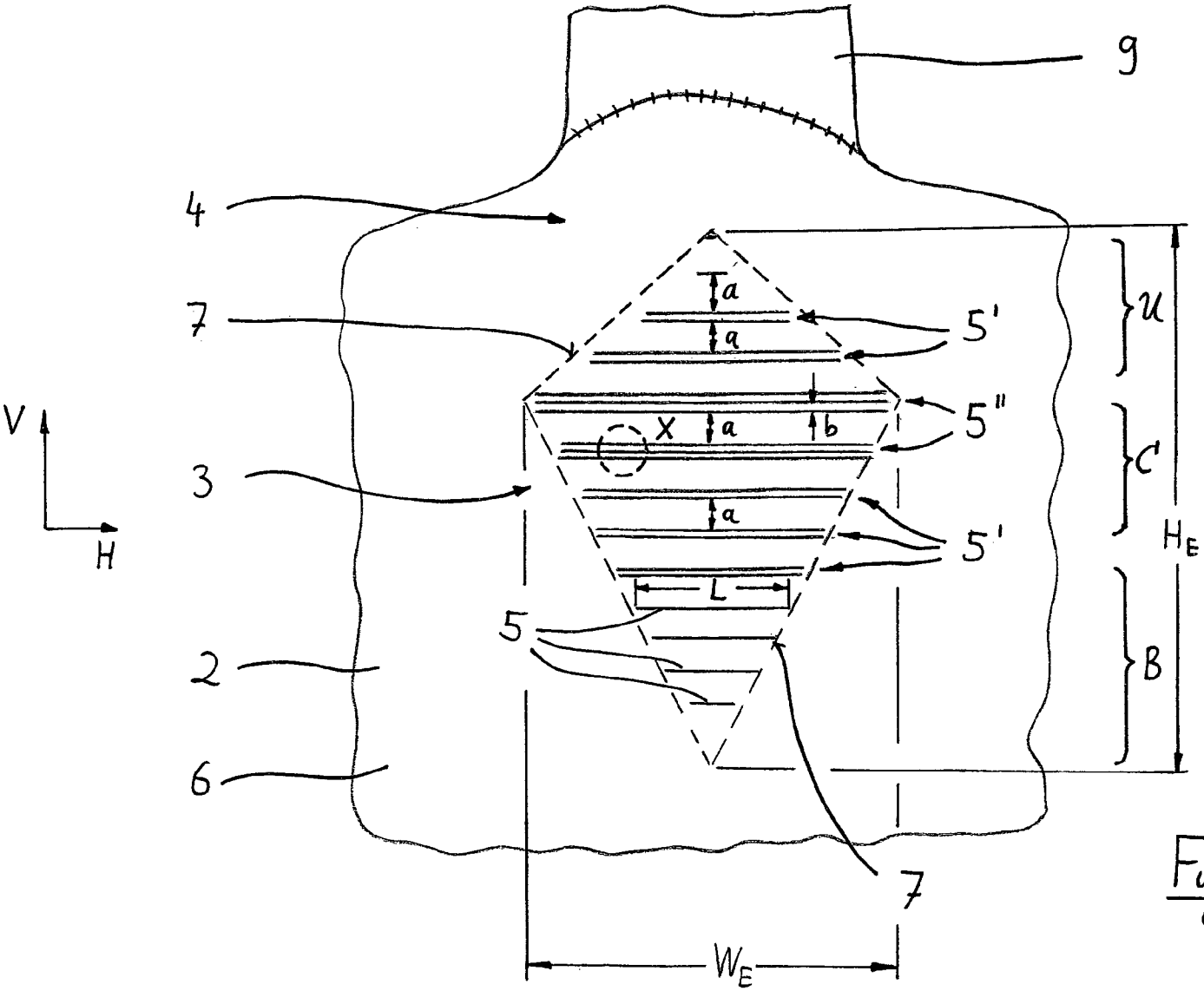
FIG. 2 shows the view of the region of the axillary area of the garment (see view "Y" in FIG. 1) with the sleeve being lifted upwards.

A part of the outer side of the garment 1 and more specifically the section below the axillary area 4 is shown in FIG. 2, wherein the sleeve 9 is lifted upwards.

Thus, it can be seen in FIG. 2 that the climate zone 3 under the axillary area 4 has a plurality of fins 5 which are arranged parallel to another. The fins 5 have as certain extension in horizontal direction H; the length of the fins 5 is denoted with L. If the ends of the fins 5 are connected by an imaginary line an envelope 7 is created which has the shape of a kite or diamond. The fins 5 are arranged on a flat base material 6 from which the garment 1 is made. The fins 5 protrude from the base material 6 to the body (skin) of the wearer (see also FIGS. 4 and 5).

In FIG. 2 certain features of the envelope 7 and thus of the design of the fins 5 can be seen. The envelope 7 has a height $H_E$ in vertical direction V and a width $W_E$ in horizontal direction H. The vertical extension of the envelope 7 can be differentiated in an upper region U, a bottom region B and a centre region C. Each region U, C and B extends along about one third of the total height $H_E$ of the envelope 7.

Figure 5:
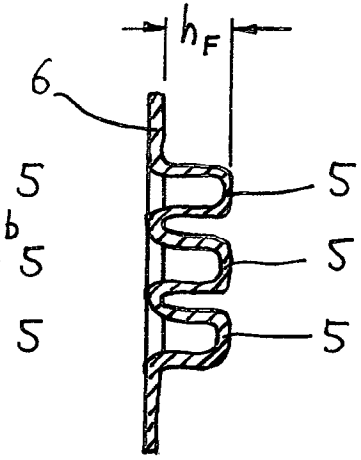
FIG. 5 shows the sectional view C-D according FIG. 3.
Figure 4:
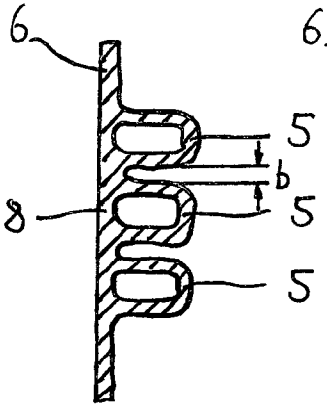
FIG. 4 shows the sectional view A-B according FIG. 3
Figure 3:
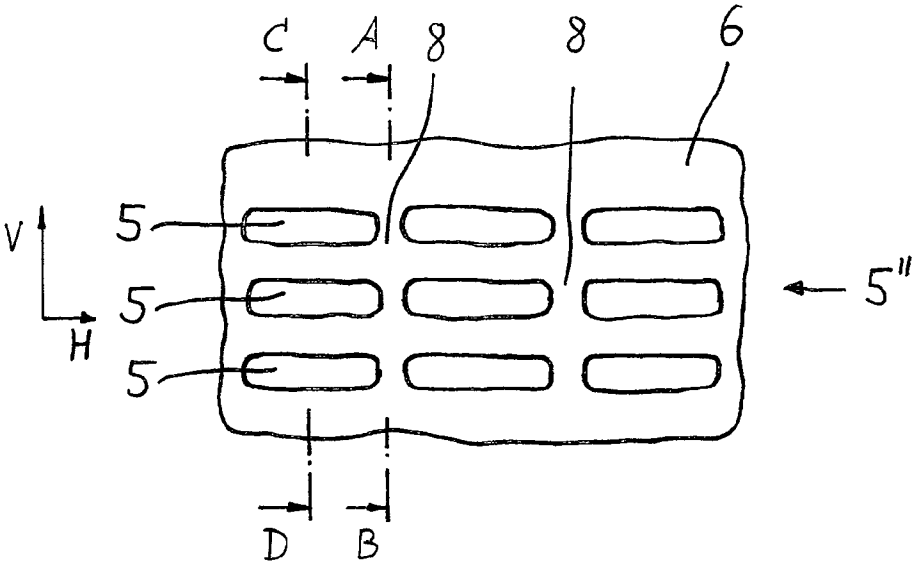
FIG. 3 shows a magnified view of detail "X" according to FIG. 2.

FIGS. 3 to 5 show details of the design of the fins 5. FIG. 3 shows an enlarged view of FIG. 2, namely the part "X" and thus the outer side of the garment 1 facing away from the skin of the user of the garment 1.

Thus in the cross-sectional views according to FIGS. 4 and 5 the left side of the base material 6 is the side facing away from the skin of the wearer, while the right side of the base material 6 is facing the skin (body) of the wearer.

In FIG. 2 it can be seen, that single fins 5 can be arranged as well as a group 5' of two fins 5 and a group 5" of three fins 5. In FIGS. 3 to 5 such a group 5" of three fins 5 is shown in detail, wherein the design shown in those figures applies as well for the single fins and the group of two fins analog.

As can be seen in FIG. 2 in each case single fins 5, groups 5' of two fins 5 or groups 5" of three fins 5 are distanced from another by a distance a. A preferred value for this distance is at least 7 mm, preferably 10 mm.

In FIGS. 4 and 5 it can be seen, that each fin 5 projects from the base material 6 by a height $h_F$ which is preferably between 1 and 3 mm. In the case that groups 5', 5" of fins are concerned (as shown in FIGS. 3 to 5) the distance between two adjacent fins 5 is small and preferably below 1 mm.

While the fins 5 are running continuously along their horizontal extension at the side which is facing the skin of the wearer, this is not the case at the outer side of the garment 1. Here, connection webs 8 are knitted which have an extension in horizontal direction H of about 1 to 3 mm and which are arranged in a horizontal distance of about 2 to 5 mm.

The connection webs 8 are bridging the fins 5 of the group 5" of fins. A surface of the webs 8 facing away from the skin of the wearer is flush with a surface of the base material 6 facing away from the skin of the wearer.

The section 2 covering the upper part of the body of the wearer and the whole climate zones 3 are produced integrally by an electronically controlled knitting process.

The proposed garment piece can be combined with other garment pieces which are worn one above the other as a tempering system.

A specific embodiment of the invention comes up with different materials for the fins 5 at the one hand side and the base material 6 on the other hand.

REFERENCE NUMERALS

1 Sports garment
2 Section covering the upper part of the body
3 Climate zone
4 Axillary area (armpit)
5 Fin
5' Group of two fins
5" Group of three fins
6 Base material
7 Envelope of all fins
8 Connection web
9 Sleeve
$h_F$ Height of the fin
$H_E$ Height of the envelope
$W_E$ Width of the envelope
a Distance
b Distance
L Length of the fin
Vertical direction
H Horizontal direction
U Upper region of the envelope
B Bottom region of the envelope

The invention claimed is:

1. A sports garment having a section covering an upper part of a body of a wearer during intended use of the garment, wherein:

the garment is made of a base material having an inner side facing the body of the wearer during intended use of the garment and an outer side facing away from the body of the wearer during the intended use of the garment, climate zones are arranged in regions covering respective armpit regions of the wearer during intended use, each of the climate zones having a plurality of fins which are arranged parallel to another, the fins projecting from the inner side of the base material by a defined height from the base material toward a skin of the wearer such that the fins directly contact the skin of the wearer during the intended use of the garment, and the base material has no contact with the skin of the wearer at the locations of the fins, the section covering the upper part including the climate zones having the plurality of fins is an integral structure of a knitted fabric made by a knitting process, and connection webs bridging a bottom side of the fins are arranged at the side of the base material facing away from the skin of the user, the fins in each of the climate zones are arranged in such a manner that an envelope of all the fins has a kite-shape, the kite-shape having a quadrilateral shape with two pairs of equal-length sides that are adjacent to each other, the fins are distributed in incremental groups with increasing number of fins bundled together towards a center region of the envelope, wherein single fins are arranged in at least one of an upper region and a bottom region of the envelope, at least one group of two fins are arranged following the single fins when moving toward the center region of the envelope, and at least one group of three fins is arranged in the center region of the envelope the single fins are distanced from each other and from the at least one group of two fins by a distance of at least 7 mm, the at least one group of two fins is distanced from the at least one group of three fins by a distance of 7 mm, and fins within the at least one group of two fins and fins within the at least one group of three fins are arranged adjacently with a distance of a maximum of 2 mm.

2. The sports garment according to claim 1, wherein the envelope has a height in vertical direction and a width in horizontal direction, wherein the height is between 120% and 160% of the width.

3. The sports garment according to claim 1, wherein a length in horizontal direction of the fins of the at least one group of two fins is between 50 mm and 90 mm.

4. The sports garment according to claim 3, wherein a length in horizontal direction of the fins of the at least one group of three fins is between 80 mm and 120 mm.

5. The sports garment according to claim 1, wherein the height of the envelope is between 140 mm and 200 mm.

6. The sports garment according to claim 1, wherein the width of the envelope is between 120 mm and 150 mm.

7. The sports garment according to claim 1, wherein the fins are made of Polyester and Polyamide yarns.

8. The sports garment according to claim 2, wherein the height of the envelope is between 130% and 150% of the width of the envelope.

9. The sports garment according to claim 1, wherein the fins of the at least one group of two fins and the fins of the at least one group of three fins are arranged adjacently with a distance of a maximum of 1 mm.

10. The sports garment according to claim 1, wherein the defined height of the fins is between 1 mm and 3 mm.

11. The sports garment according to claim 1, wherein the fins are folds in the knitted fabric.

12. The sports garment according to claim 1, wherein a surface of the connection webs facing away from the skin of the wearer during intended use is flush with a surface on the outer side of the base material facing away from the skin of the wearer during intended use.

13. The sports garment according to claim 1, wherein the garment includes sleeves and the climate zones are respectively arranged under the sleeves of the garment.

14. The sports garment according to claim 1, wherein the center region of the envelope includes a widest portion of the kite-shape.

* * * * *